US005390376A

United States Patent [19]

Marx et al.

[11] Patent Number: 5,390,376

[45] Date of Patent: * Feb. 21, 1995

[54] BREATHABLE BODY WEAR

[75] Inventors: Gilda G. Marx; Robert S. Marx, both of Los Angeles, Calif.

[73] Assignee: Gilda Marx Industries, Inc., Los Angeles, Calif.

[ * ] Notice: The portion of the term of this patent subsequent to Oct. 6, 2009 has been disclaimed.

[21] Appl. No.: 954,587

[22] Filed: Sep. 30, 1992

Related U.S. Application Data

[63] Continuation-in-part of Ser. No. 553,963, Jul. 17, 1990, Pat. No. 5,152,014.

[51] Int. Cl.[6] ..... A41B 9/04

[52] U.S. Cl. ..... 2/406; 2/409; 2/402; 2/403; 2/228

[58] Field of Search ..... 2/406, 409, 78 B, 69, 2/402, 403, 400, 228, 407, 78.2; 450/102, 103, 104, 105

[56] References Cited

U.S. PATENT DOCUMENTS

| | | | |
|---|---|---|---|
| 2,799,023 | 7/1957 | Goodman | 2/69 |
| 3,237,625 | 3/1966 | Johnson | 2/400 |
| 3,701,164 | 10/1972 | Blore | 2/224 R |
| 3,909,851 | 10/1975 | Garrou et al. | 2/224 R |
| 4,009,495 | 3/1977 | Faust | 2/406 |
| 4,031,568 | 6/1977 | Huff | 2/406 |
| 4,067,068 | 1/1978 | Bregstein et al. | 2/406 |
| 4,236,257 | 12/1980 | Williams et al. | 2/406 |
| 4,244,059 | 1/1981 | Pflaumer | 2/400 |
| 5,152,014 | 10/1992 | Marx et al. | 2/409 |

OTHER PUBLICATIONS

Japanese Laid-Open Publication No. 61-124610.
Coolmax Newsletter, Spring 1989.
Bike Nashbar Catalog #51, Late Summer 1987.

*Primary Examiner*—Andrew M. Falik
*Assistant Examiner*—Gloria Hale
*Attorney, Agent, or Firm*—Poms, Smith, Lande & Rose

[57] ABSTRACT

A breathable garment having an inner panel in the crotch area made of an open knit material formed of hydrophobic fiber having a large surface area and longitudinally extending channels which transports or "wicks" moisture away from the body, thereby helping to keep intimate areas drier, cooler, and more comfortable.

18 Claims, 4 Drawing Sheets

FIG. 1
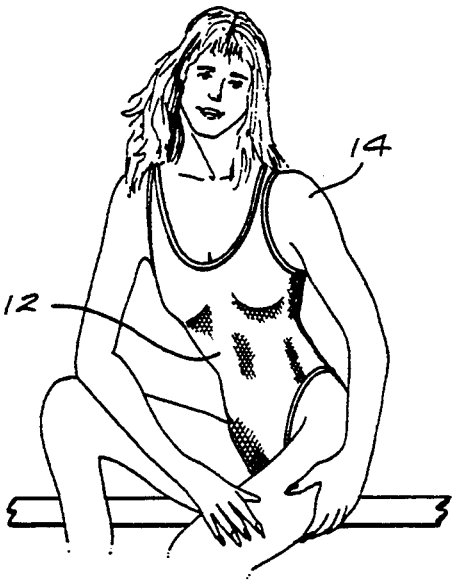
FIG. 2
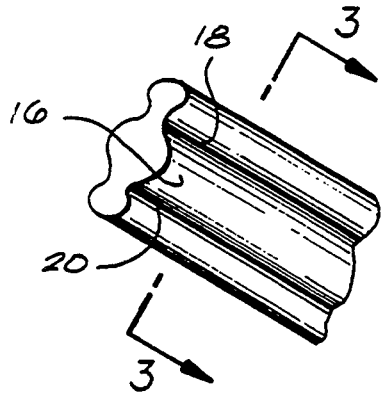
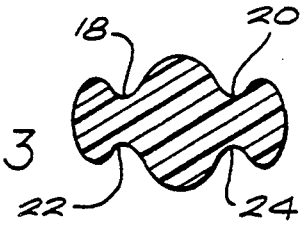
FIG. 3
FIG. 4
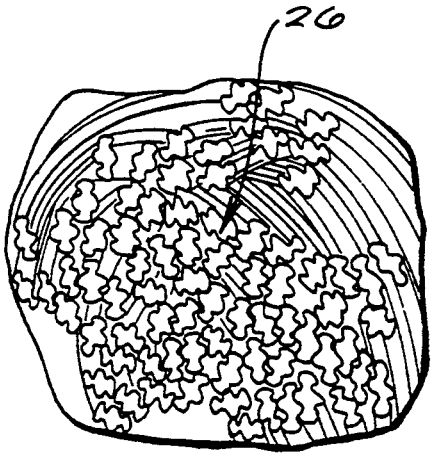
FIG. 5
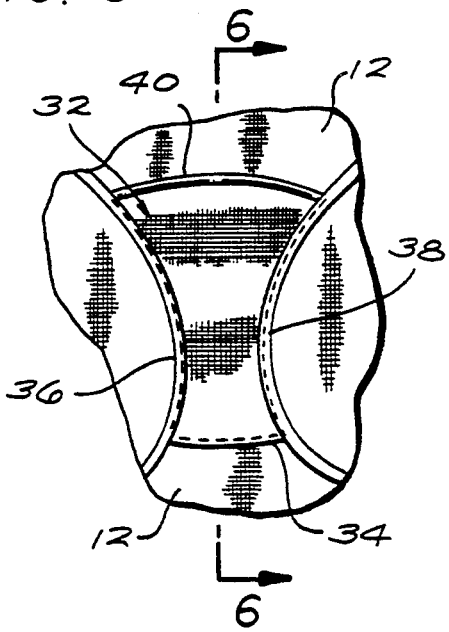

BREATHABLE BODY WEAR

RELATED APPLICATIONS

This application is a Continuation-in-Part of parent application, Ser. No. 07/553,963, filed Jul. 17, 1990, now U.S. Pat. No. 5,152,014.

FIELD OF THE INVENTION

The present invention relates to clothing, more specifically to garments which are lined with an additional material to encourage moisture migration.

BACKGROUND OF THE INVENTION

Clothing worn during periods of exercise, activity or perspiration producing events typically becomes saturated with the perspiration or moisture which is retained against the skin. In infants, this retained moisture may cause a diaper rash. For others, this accumulated moisture may produce an annoying itch, may generate excessive body odor as the moisture is allowed to rest against the skin.

Particular areas of the body are more susceptible to aggravation from exposure to a moist environment. This is especially true in the crotch area of undergarments. Amongst women, the wearing of tight undergarments which retain moisture is one of the contributing factors of vaginitis, including one of the most common types, candidiasis, or yeast infection. Amongst men, the accumulation of moisture in the crotch area may cause or aggravate a condition commonly referred to as jock itch.

The itching and discomfort associated with these conditions in men and women is aggravating and annoying to a large number of people. If this annoyance continues, physicians often recommend that the patients avoid tight fitting clothing, or switch to undergarments which have a cotton crotch area. The wearing of cotton undergarments was previously advised due to cotton's ability to absorb moisture.

However, the retention of moisture in the cotton material may, in fact, aggravate the condition or at least not relieve it significantly.

Accordingly, one object of the present invention is to provide body wear which provides dryer conditions and contributes to a reduction in the conditions which aggravate jock itch, and favor yeast infections and vaginitis.

SUMMARY OF THE INVENTION

In accordance with the present invention, it has been determined that the use of a liner inserted in the crotch area made of open knit material formed of a hydrophobic fiber having an irregular outer surface configuration and, accordingly having a high surface area, transports or "wicks" moisture away from the body, thereby helping to keep intimate area dryer, cooler and more comfortable. Collaterally, the moist conditions which favor jock itch and the generation of yeast infections are reduced.

An open knit fabric formed of the Dupont fiber identified as "COOLMAX" has been found to have the desirable qualities for a liner as outlined above.

In some cases, it is useful to provide an inner open knit panel of high surface area hydrophobic fiber material and a mating outer knit panel of cotton or similar absorbent material, both in the crotch area of the garment. The loosely knit inner panel is preferably seamed or stitched along all of its edges to avoid unraveling of the material. In some cases, it is seamed to the body wear on all edges, and in other cases, for example, where a panel is sewn into a bathing suit along only three sides, the fourth, free side of the panel has its edge seamed to the body wear to avoid unraveling.

Other objects, features and advantages of the present invention become apparent from a consideration of the following detailed description and from the accompanying drawings.

BRIEF DESCRIPTION OF THE DRAWINGS

FIG. 1 shows a breathable body wear garment illustrating the principles of the invention, and being worn by a model;

FIG. 2 is an isometric view of a fiber having a large surface area compared to its cross-sectional volume;

FIG. 3 is an isometric view of a fiber of FIG. 2;

FIG. 4 shows a thread formed of a bundle of fibers of the type shown in FIGS. 2 and 3;

FIG. 5 shows an inner panel of loosely woven knit material located in the crotch area of the body wear garment, as shown in FIG. 1, and employing threads of the type shown in FIG. 4;

DETAILED DESCRIPTION OF PREFERRED EMBODIMENTS OF THE INVENTION

Figure 6:
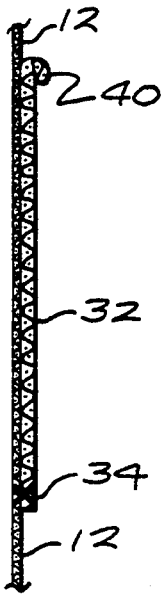
FIG. 6 is a cross-sectional view taken along lines 6—6 of FIG. 5.

Referring more particularly to FIG. 1 of the drawings, it shows a typical women's body wear garment 12 worn by a model 14. To be discussed hereinbelow is the new construction provided in the body wear, including a special panel in the crotch area of the body wear garment.

The special panel, as mentioned hereinabove, is formed of a loose weave knit material in which the basic fiber has an irregular outer surface, preferably including longitudinally extending channels, and has a corresponding high surface area. One fiber which may be employed is the Dupont fiber sold under the trademark "COOLMAX". FIGS. 2 and 3 show the configuration of the based "COOLMAX" fiber 16 with FIG. 2 being an isometric view of one end of one of the fibers, and FIG. 3 being a cross-sectional view taken along lines 3—3 of FIG. 2. The fiber has longitudinally extending channels 18, 20, 22 and 24, and these "wicking" channels transport liquid away from the body. The fiber is preferably made of hydrophobic material having low moisture absorption, which prevents clinging, and contributes to the lightweight "feel" characteristic of fabrics made using this fiber.

FIG. 4 is an end view of a thread formed of a bundle of the fibers of the type shown in FIGS. 2 and 3. The irregular packing of the fibers creates added voids in the fiber bundle, allowing greater moisture and vapor transport and breathability.

Instead of the cross-section as shown in FIG. 3, the fibers employed in one implementation of the present invention could be formed of other hydrophobic fibers having longitudinally extending channels, for example, a generally circular fiber with a series of deep channels cut into its periphery, or a fiber having a cross-section similar to that of FIG. 3, but with another one or two bumps or lobes extending from the central area of the fiber, or from either or both of the two side lobes thereof.

FIG. 5 is a view showing the inside of the crotch area in the bathing suit 12 of FIG. 1. In FIG. 5, the bathing suit 12 appears at the upper and lower ends of the figure, and a special loosely knit panel 32 is seamed into the bathing suit 12, along the line 34, and at the two sides 36 and 38 of the garment. The rear edge 40 of the knit insert is seamed to prevent unraveling of the knit fabric, but is not secured to the bathing suit outer material 12.

The knit panel 32 is formed of an open knit fabric, which may be formed using threads as shown in FIG. 4, made with fibers of the type shown in FIGS. 2 and 3. Accordingly, the panel 32 is a loose knit fabric with an open configuration, using hydrophobic fibers having an irregular outer surface, preferably including longitudinally extending channels, with the fibers therefore having a high surface area relative to the cross-sectional view taken along lines 6—6 of FIG. 5. As indicated in FIGS. 5 and 6, the loosely knit panel 32 is seamed into the bathing suit material along the seam 34 toward the front of the bathing suit, and at the two side edges 36, 38 of the bathing suit. The rear edge of the panel 32 is provided with a seam 40, as indicated in FIGS. 5 and 6, to prevent unraveling of the rear edge thereof, but is not secured to the bathing suit 12. It is made of tightly woven or tightly knit, relatively thin material but includes resilient and stretchable fibers, so that the bathing suit will stretch. As contrasted with the thinner, stretchable material 12, the panel 32 is looser, porous, and several times thicker, or at least twice as thick as the thinner material 12.

Figure 7:
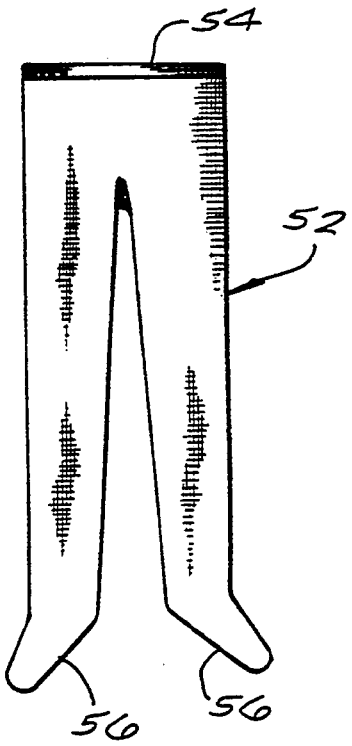
FIG. 7 shows a pair of black tights, illustrating the principles of the present invention.

Now, a different body wear garment, black tights, are shown in FIGS. 7 through 10 of the drawings. FIG. 7 shows an overall view of the tights 52 having an elastic waistband 54, and feet 56. The overall material of the black tights is a relatively thin, closely woven or tightly knit, thin material and is preferably stretchable. A typical fabric which may be used includes 64% cotton, 29% nylon, and 7% LYCRA TM, or 93% lycra, 7% cotton.

Figure 8:
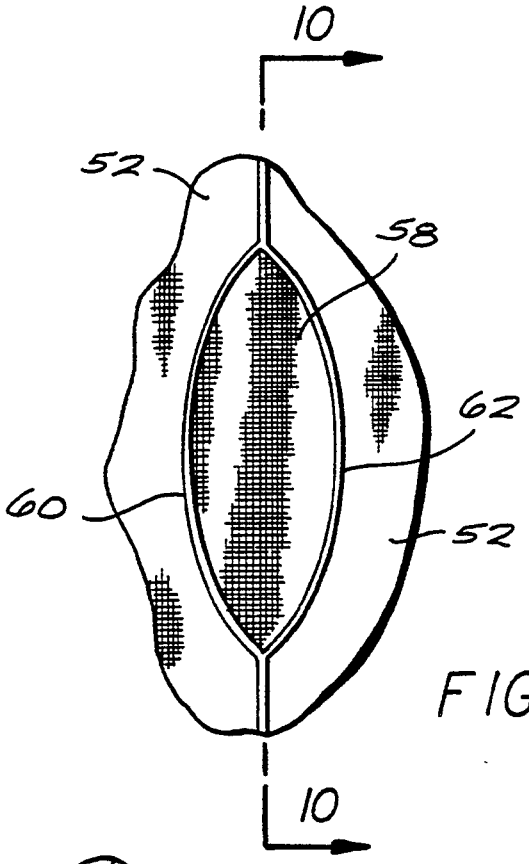
FIG. 8 is an outside view of the crotch area of the tights shown in FIG. 7.
Figure 9:
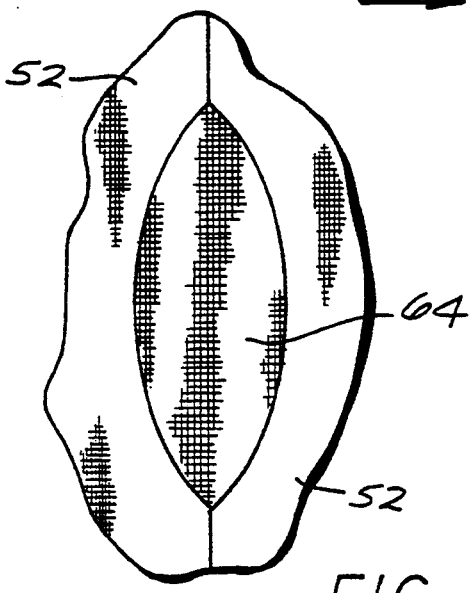
FIG. 9 is an inside view showing a crotch panel of open knit material, located on the inside of the tights of FIG. 7.
Figure 10:
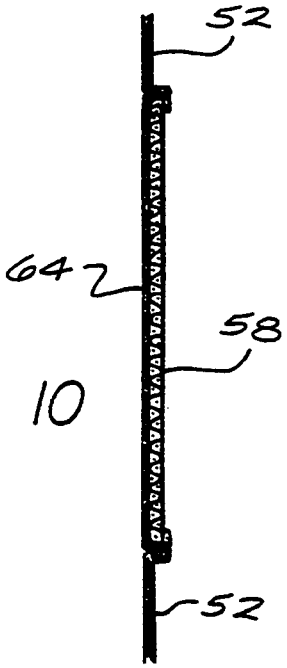
FIG. 10 is a cross-sectional view taken along lines 10—10 of FIG. 9.

FIGS. 8, 9 and 10 show the crotch area of the tights shown in FIG. 7. More specifically, FIG. 8 shows the loosely knit panel 58 which is sewn and fully seamed into the crotch area of the black tights 52. The panel 58 is substantially diamond-shaped and is seamed to the adjacent material of the tights along the two seams 60, 62. FIG. 9 shows the outside of the tights in the crotch area, and shows a similar panel 64 which is coextensive with the inner panel 58, but is of the same color, black, as the remainder of the tights material 52. The panel 64 may be formed of loosely knit absorbent material, such as cotton. The cross-sectional view of FIG. 10 is taken along lines 10—10 of FIG. 8.

Figure 11:
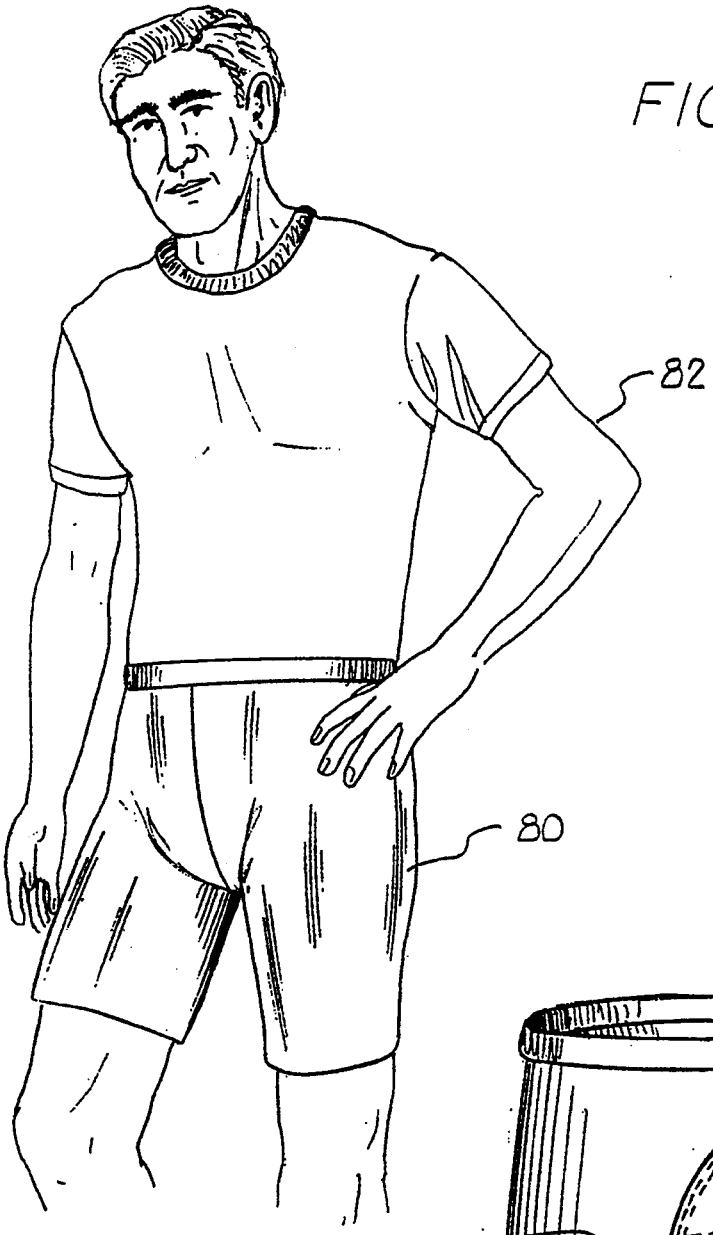
FIG. 11 shows a breathable body wear garment illustrating the principles of the invention, and being worn by a model.

Referring to FIG. 11 of the drawings, it shows a typical pair of men's shorts 80 worn by a model 82. The special panel, as mentioned hereinabove and applied to women's body wear garments, is affixed to the inside of the shorts and located in the crotch area.

Figure 12:
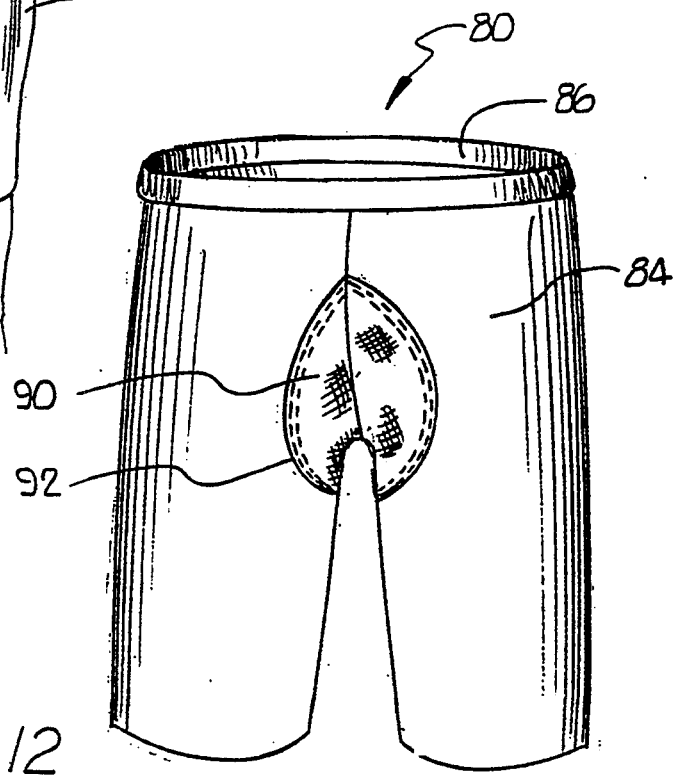
FIG. 12 is an inside out view of the shorts shown in FIG. 11.

FIG. 12 is a view showing shorts 80, as in FIG. 11, turned inside out and showing the crotch area of the inside of the shorts 80. In FIG. 12, the shorts 80 is shown surrounding a special loosely knit panel 90 which is located in the crotch area of the shorts 80. An elastic waistband 86 may be located around the waist of the shorts and may include a drawstring (not shown). The material making up the bulk of the shorts 84 is preferably a nylon/lycra type material, as described for the bodywear garment of FIGS. 7–10, that is stretchable to accommodate the size and shape of the wearer. The material 84 is permeable to moisture.

The special loosely knit panel 90 is attached by stitching 92 to the crotch area of shorts 80. In one implementation of the present invention, the special loosely knit panel 90 is roughly cut and is stitched into shorts 80 by stitching 92 around all edges of the special loosely knit panel 90 in order to prevent unraveling of the special loosely knit panel 90. This implementation allows relatively inexpensive manufacturing and assembly costs for the shorts 80. In an alternative embodiment, the special loosely knit panel 90 may be seamed along its edges prior to being affixed to the crotch area of shorts 80. This additional step will help to further prevent unraveling of the special loosely knit panel 90, but will add additional expense and may create a outline of the special loosely panel 90 which may be visible when the shorts are worn.

The composition of the shorts 80 adjacent to the special loosely knit panel 90 must be porous enough to allow moisture which is wicked away from the wearer of the shorts 80 through the special loosely knit panel 90 to pass through the outer layer of shorts 80 and evaporate. If the shorts 80 are formed of rubber or other material which prevents the passage of moisture, all of the moisture will be retained against the skin of the wearer, and the benefits of the present invention may not be realized.

Figure 13:
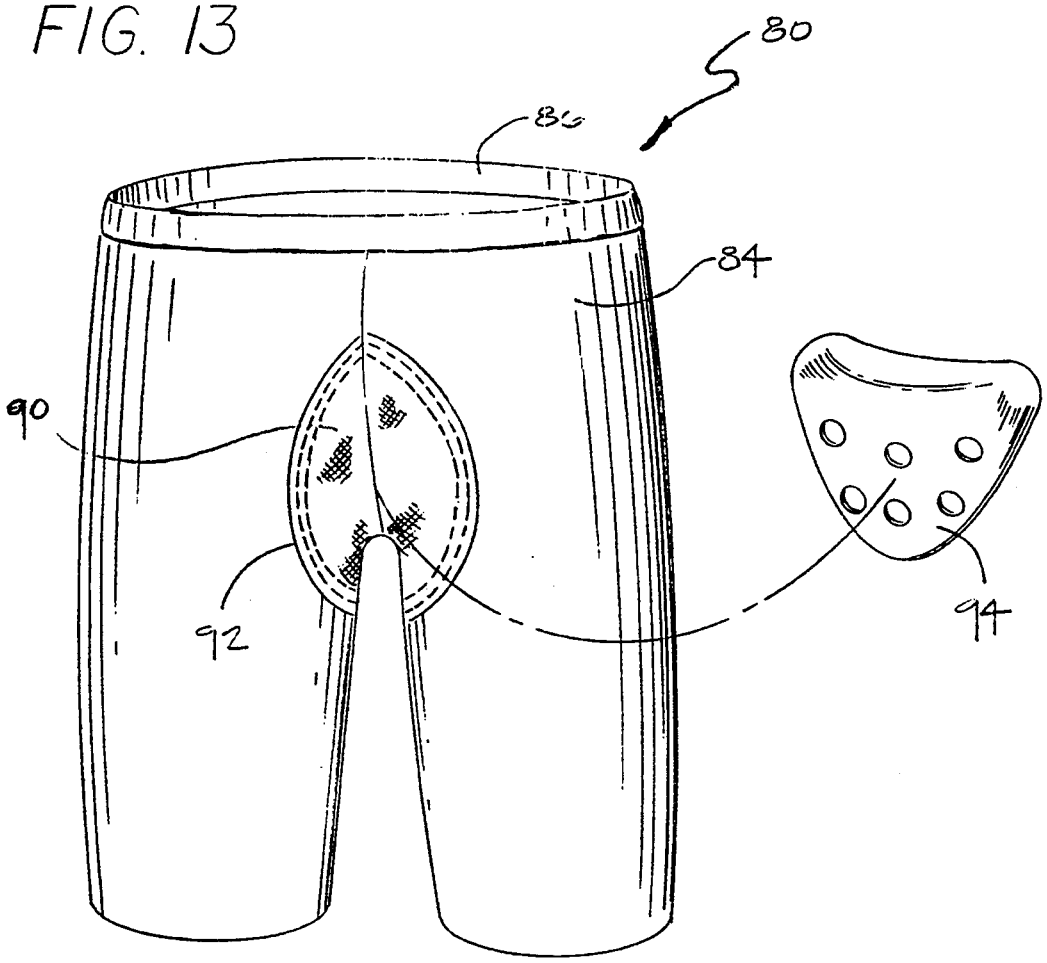
FIG. 13 is an inside out view of the shorts shown in FIG. 11 showing the panel being used for a protective cup.
Figure 14:
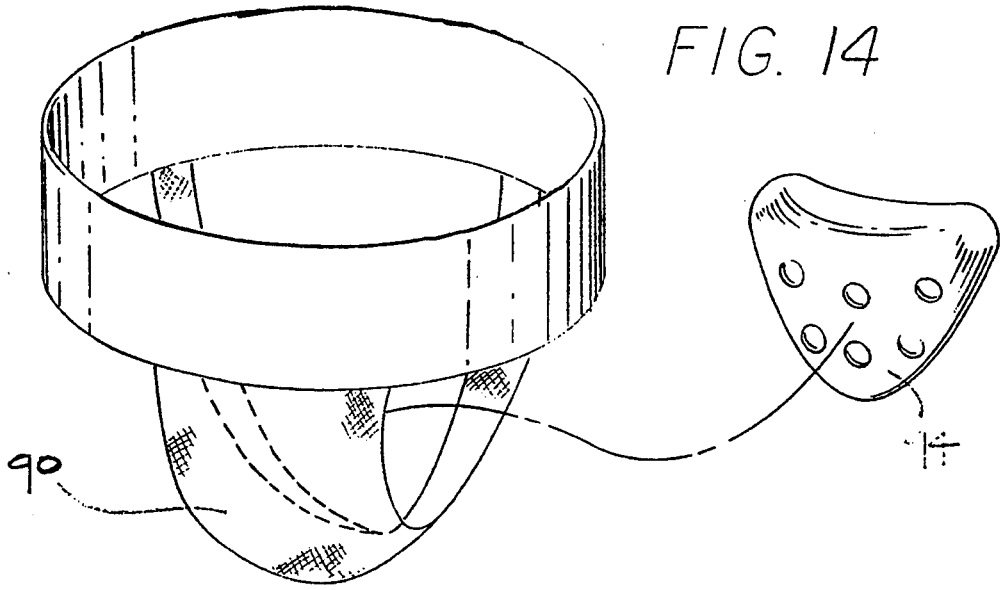
FIG. 14 is an athletic supporter.

The special loosely knit panel 90 may also be used to line an athletic supporter (jock strap), protective cup 94, swimming trunks and underwear in a similar manner to that described above, by affixing the special loosely knit panel 90 to the crotch area of the inside surface of the garments, as shown in FIGS. 12–14.

Using the configuration of FIGS. 7–12, moisture is "wicked" away from the body of the wearer, and transmitted to the absorbent panel 64 which is exposed to the air so that moisture absorbed there may be readily dried by exposure to the air. The result is a drier and more comfortable feeling for the wearer, with the drier conditions tending toward inhibiting potentially undesirable yeast growth or other possible infections.

In conclusion, it is to be understood that the foregoing detailed description and the accompanying drawings relate to preferred embodiments of the present invention. Various changes and modifications may be made without departing from the spirit and scope of the invention. Thus, by way of example and not of limitation, the present invention is applicable to all types of men's and women's body wear, including bathing suits, shorts, tights, pantyhose, leotards, and the like. Further, instead of using COOLMAX TM, other hydrophobic fibers having large surface areas could be employed, preferably those with longitudinal channels included in their structure. In addition, instead of using knit panels, other panels formed of this type of fiber and having a relatively open weave may be employed. Accordingly, the present invention is not limited precisely to the materials and structures described in detail hereinabove and shown in the accompanying drawings, but solely to the scope of the following claims:

What is claimed:

1. A breathable garment comprising:

a main garment having a body area and a crotch area, and an inside surface and outside surface;

an inner panel having an inner and outer surface inserted in the crotch area of said main garment, and located on the inside surface of said main garment, with said inner surface of said inner panel facing, and immediately adjacent to said inside surface of said main garment;

said inner panel being formed of an open knit material formed of high surface area hydrophobic fibers;

said inner panel being formed of threads made up of bundles of said hydrophobic fibers;

said high surface area hydrophobic fibers of said inner panel having an outer peripheral surface and having longitudinally extending channels on said outer peripheral surface; and said main garment being formed of a porous material in the crotch area thereof.

2. A breathable garment as described in claim 1 in which said main garment is formed of a thin stretchable material, and said inner panel is formed of a material which is substantially thicker and substantially more porous than said thin, stretchable material.

3. A breathable garment as described in claim 2 in which said main garment is principally formed of a stretchable material and wherein said main garment has, in an area overlying said inner panel, porous material constituting means for permitting sufficient air circulation through said main garment to promote evaporation of moisture transferred from said inner panel to said main garment.

4. A breathable garment as described in claim 1 wherein the color of said main garment material is different from the color of said inner panel.

5. A breathable garment as described in claim 1 in which the crotch area of said body wear garment consists solely of said inner panel layer and one thin outer layer of stretchable material.

6. A breathable body wear garment comprising:

a main body wear garment having a body and a crotch area, and an inside surface and outside surface;

an inner panel located on the inside surface of the main body wear garment in the crotch area thereof, said inner panel being formed of high surface area hydrophobic fibers; and said main body wear garment being formed of a porous material in the crotch area thereof; said main body wear garment further comprising a knit panel in an area overlying said inner panel and being of a more porous material than said main body wear garment material.

7. A breathable body wear garment as defined in claim 6 in which said main body wear garment is principally formed of a stretchable material.

8. A breathable body wear garment as defined in claim 6 wherein the color of said main body wear garment material is different from the color of said inner panel.

9. A breathable body wear garment as defined in claim 6 in which all edges of said inner panel are secured to said main body wear garment.

10. A breathable body wear garment as defined in claim wherein at least one edge of said inner panel is seamed to prevent unraveling.

11. A breathable garment as described in claim 6 in which the crotch area of said garment consists solely of said inner panel layer, and multiple thin layers of outer material which constitute the main garment such that moisture can be effectively transferred from the inner panel to the external surface of the garment where said moisture can evaporate.

12. A breathable body wear garment comprising:

a main body wear garment having a body and a crotch area, and an inside surface and outside surface;

an inner panel located on the inside surface of the main body wear garment in the crotch area thereof, said inner panel being formed of high surface area hydrophobic fibers; and said main body wear garment being formed of a porous material in the crotch area thereof;

said main garment being formed of thin material, and said inner panel being formed of material which is substantially thicker and substantially more porous than said thin material.

13. A breathable garment comprising:

a main garment having a body portion and a crotch area, and an inside surface and outside surface;

an inner panel attached to said inside surface of said main garment located in the crotch area thereof, said inner panel being formed of an open knit material formed of high surface area hydrophobic fibers;

said inner panel being formed of threads made up of bundles of said hydrophobic fibers;

said main garment being formed of a porous material in the crotch area, said porous material constituting means for permitting the passage of moisture from the inside surface of said main garment to the outside surface of said main garment, said main garment being formed of a thin material, and said inner panel being formed of a material which is substantially thicker and substantially more porous than said thin material.

14. A breathable garment as described in claim 13 in which said inner panel is stitched to said main garment along all edges of said inner panel in order to prevent unraveling of said inner panel.

15. A breathable garment as described in claim 13 in which said crotch area of said garment consists solely of said main garment and said inner panel.

16. A breathable garment as described in claim 13 in which the crotch of said garment consists solely of said inner panel layer, and multiple thin layers of outer material which constitute the main garment such that moisture can be effectively transferred from said inner panel to the outside surface of said main garment where said moisture can evaporate.

17. A breathable garment as described in claim 13 in which said garment is a pair of shorts.

18. A breathable garment as described in claim 13 in which said garment is an athletic supporter.

* * * * *

UNITED STATES PATENT AND TRADEMARK OFFICE

CERTIFICATE OF CORRECTION

PATENT NO. : 5,390,376

DATED : February 21, 1995

INVENTOR(S) : Gilda G. Marx and Robert S. Marx

It is certified that error appears in the above-identified patent and that said Letters Patent is hereby corrected as shown below:

Col. 6, line 9, after claim, insert --6--.

Signed and Sealed this

Twenty-second Day of August, 1995

*Attest:*

Bruce Lehman

BRUCE LEHMAN

*Attesting Officer*

*Commissioner of Patents and Trademarks*